US005309729A

United States Patent [19]

Sagar

[11] Patent Number: 5,309,729

[45] Date of Patent: May 10, 1994

[54] THERMAL PURGE SYSTEM

[76] Inventor: Christopher L. Sagar, 1823 Hicks Rd., Rolling Meadows, Ill. 60008

[21] Appl. No.: 81,771

[22] Filed: Jun. 23, 1993

[51] Int. Cl.[5] ..... F25B 43/04

[52] U.S. Cl. ..... 62/195; 62/475

[58] Field of Search ..... 62/475, 195, 149, 85

[56] References Cited

U.S. PATENT DOCUMENTS 4,169,356 10/1979 Kingham ..... 62/85

5,261,246 11/1993 Blackmon ..... 62/475

*Primary Examiner*—John M. Sollecito

*Attorney, Agent, or Firm*—Joseph C. Mason, Jr.; Ronald E. Smith

[57] ABSTRACT

A thermal purge system includes a purge vessel into which is introduced hot gaseous refrigerant fluid from the outlet of a conventional chiller. A first coil having very cold refrigerant fluid flowing through it is positioned within the vessel so that much of the hot gaseous refrigerant fluid from the chiller is condensed upon contact with the coil. The condensate collects on the bottom of the vessel until it reaches a depth sufficient to initiate a syphoning action by an artesian well which returns the condensate to the chiller. Uncondensed gases are reheated and re-expanded external to the vessel and returned to the vessel through a second coil in heat transfer relation to the first coil so that further condensation occurs. Noncondensibles which remain after the reheating, re-expansion, and recooling are purged to the atmosphere.

18 Claims, 2 Drawing Sheets

THERMAL PURGE SYSTEM

BACKGROUND OF THE INVENTION

1. Field of the Invention

This invention relates to improvements in air conditioning systems. More particularly, it relates to a thermal purge system that removes non-condensibles from a refrigerant fluid without discharging CFCs into the atmosphere.

2. Description of the Prior Art

In air conditioning systems, a refrigerant is alternately expanded into a gaseous state and condensed into a liquid state; heat is absorbed and released, respectively, as a result of such expansion and contraction. When the refrigerant is pure and unadulterated by contaminants such as air and moisture, the condensation is complete and the system operates at maximum efficiency; when contaminates enter the refrigerant, however, the condensation equipment is unable to condense all of such contaminates, and the efficiency of the system drops accordingly. In the industry, contaminants that cannot be condensed are known as "noncondensibles."

Noncondensibles enter most air conditioning systems because parts of such systems operate under a vacuum. Thus, those of ordinary skill in the art have attempted to build leak-proof systems, but a truly leak-proof system would be cost-prohibitive.

Most inventors, however, have accepted the fact of leakage and have developed systems designed to purge noncondensibles from the system. For example, U.S. Pat. No. 5,031,410 to Plzak, et. al., shows a refrigeration system thermal purge apparatus that adds a discrete purge refrigerant circuit to the conventional refrigerant circuit; the condensibles that are not condensed by the conventional condenser are exposed to the still lower temperatures of an auxiliary condensor. When the temperature within the auxiliary condensor drops to 18° F., as detected by a thermostat, the contents of said auxiliary condensor are purged to the atmosphere. Although, at 18° F., some separation of condensibles and noncondensibles will have been achieved, complete separation will not have been achieved; thus, some condensibles such as CFCs will be purged into the atmosphere. Moreover, thermostats are relatively unreliable within a five degree range; thus, purging may occur when the temperature within the auxiliary condensor is as high as 23° F., and even less separation will have occurred at that temperature.

Thus, there is a need to provide a purge apparatus that provides a complete separation of condensibles and noncondensibles before the noncondensibles are purged to the atmosphere.

Moreover, the thermal purge units heretofore known are inefficient to the extent that they perform an extra condensation step, over and above the conventional step, but do not hold the condensible/noncondensible mixture at a low temperature for extended periods of time. Thus, insufficient time is available for the condensibles and noncondensibles to separate. The known systems also operate best under low load conditions, i.e., they are inefficient at high temperature gradients, because they lack means for metering additional liquid refrigerant into the auxiliary system as the load on the system increases.

There is a need, therefore, for a system that does more than merely provide an auxiliary condensation system that does not produce a complete separation of condensibles and noncondensibles.

When the prior art was considered as a whole, at the time the present invention was made, it neither taught nor suggested to those of ordinary skill in this field how an improved system could be built.

SUMMARY OF THE INVENTION

The present invention introduces to the art a novel auxiliary condensation process that efficiently achieves complete separation of condensibles and noncondensibles, and which includes a novel reheat and re-expansion apparatus. Moreover, the novel system includes means for increasing the amount of liquid refrigerent in the auxiliary system when it is under heavy load so that it operates at or near maximum efficiency at all times. Significantly, purging occurs only when the condensibles and noncondensibles have been fully separated from one another so that the possibility of purging CFCs into the atmosphere is minimized.

The inventive apparatus includes a novel purge vessel; it receives refrigerant including condensibles and noncondensibles from the condenser of a conventional chiller and condenses said refrigerant a second time by bringing it into heat transfer relation with an auxiliary condenser means that includes a second liquid refrigerant maintained at a very low temperature. This secondary condensation, or recondensation, results in a further separation of condensibles and noncondensibles. The condensibles condensed within the purge vessel by said secondary condensation process are returned to the lower part of the chiller condenser barrel, and the apparent noncondensibles that have resisted the primary and secondary condensation processes are routed to a novel reheat and re-expansion means that is positioned external to said purge vessel. Said reheating and re-expansion is triggered by a drop in temperature within the purge vessel to a predetermined temperature, said predetermined temperature being detected by a highly accurate electronic sensor. After such reheating and re-expansion, the reheated and re-expanded refrigerant is returned to the purge vessel where it is again cooled by being brought into heat transfer relation to liquid refrigerant at an extremely low temperature. This tertiary condensation process is maintained for a predetermined time, such as three minutes, to effectively separate all condensibles from the noncondensibles. A temperature-sensitive purge cycle then purges the noncondensibles into the atmosphere.

It is therefore clear that an important object of this invention is to improve the efficiency of air conditioning systems by removing noncondensibles therefrom in a highly efficient manner so that the system operates at or near maximum efficiency at all times.

A more specific object is to provide an apparatus that performs secondary and tertiary condensation of refrigerant.

Another important object is to provide an apparatus that reheats and re-expands refrigerant after it has undergone a secondary condensation and before it undergoes a third condensation.

Still another important object is to provide an apparatus that prolongs the auxiliary condensation process for a predetermined period of time to further ensure complete preparation of condensibles and noncondensibles.

These and many other important objects, features and advantages of the invention will become apparent as this description proceeds.

The invention accordingly comprises the features of construction, combination of elements and arrangement of parts that will be exemplified in the construction hereinafter set forth, and the scope of the invention will be indicated in the claims.

BRIEF DESCRIPTION OF THE DRAWINGS

For a fuller understanding of the nature and objects of the invention, reference should be made to the following detailed description, taken in connection with the accompanying drawings, in which.

DETAILED DESCRIPTION OF THE PREFERRED EMBODIMENT

Figure 1:
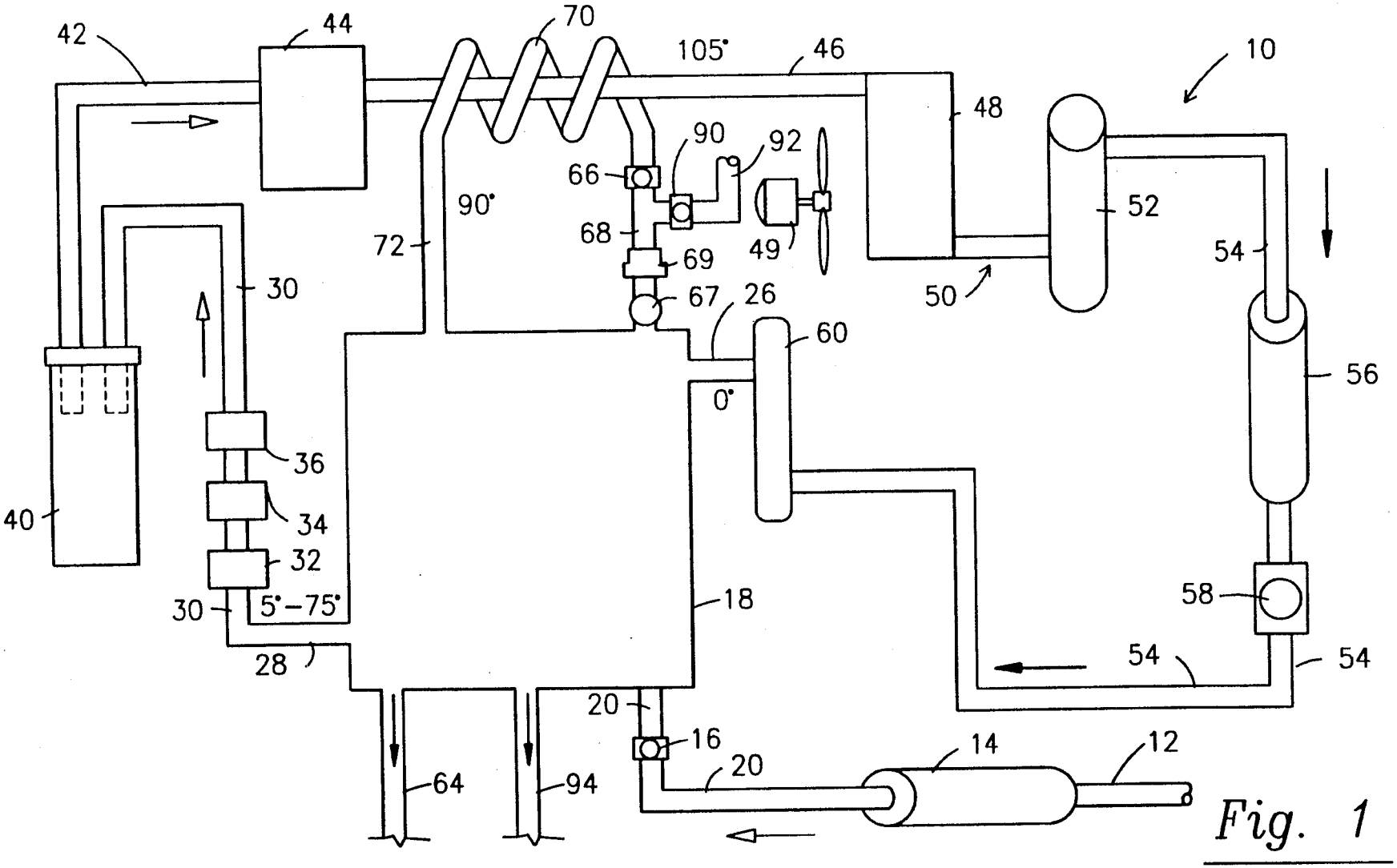
FIG. 1 is a diagrammatic view of the novel system.

Referring now to FIG. 1, it will there be seen that an exemplary embodiment of the invention is denoted as a whole by the reference numeral 10.

It should be understood from the outset that the conventional centrifugal chiller, not shown, to which the novel unit 10 is attached, performs the primary function of condensing the refrigerant in the air conditioning system, and that condensed liquid refrigerant circulates in the conventional air conditioning system without the aid of the novel system disclosed herein. The novel system receives from the conventional chiller only those hot gases that are not condensed by said chiller. These hot gases will contain condensibles that were not condensed by the chiller, and true noncondensibles that must be purged into the atmosphere.

More particularly, hot, moisture-containing gaseous refrigerant enters novel system 10 through chiller outlet line 12, shown at the bottom right hand corner of FIG. 1. A forty eight (48) core drier 14, or other suitable drying means, removes moisture from such incoming hot gaseous refrigerant as a preliminary step. Normally open solenoid valve 16 admits the dry, hot gaseous refrigerant into purge vessel 18 except when a purge of noncondensibles to atmosphere is under way. The conduit that provides fluid communication between drier means 14 and solenoid 16 is denoted 20. The same conduit 20 extends from solenoid 16 into the interior of vessel 18; in the claims that follow, where conduit 20 enters the vessel is referred to as the first inlet of the purge vessel.

Figure 2:
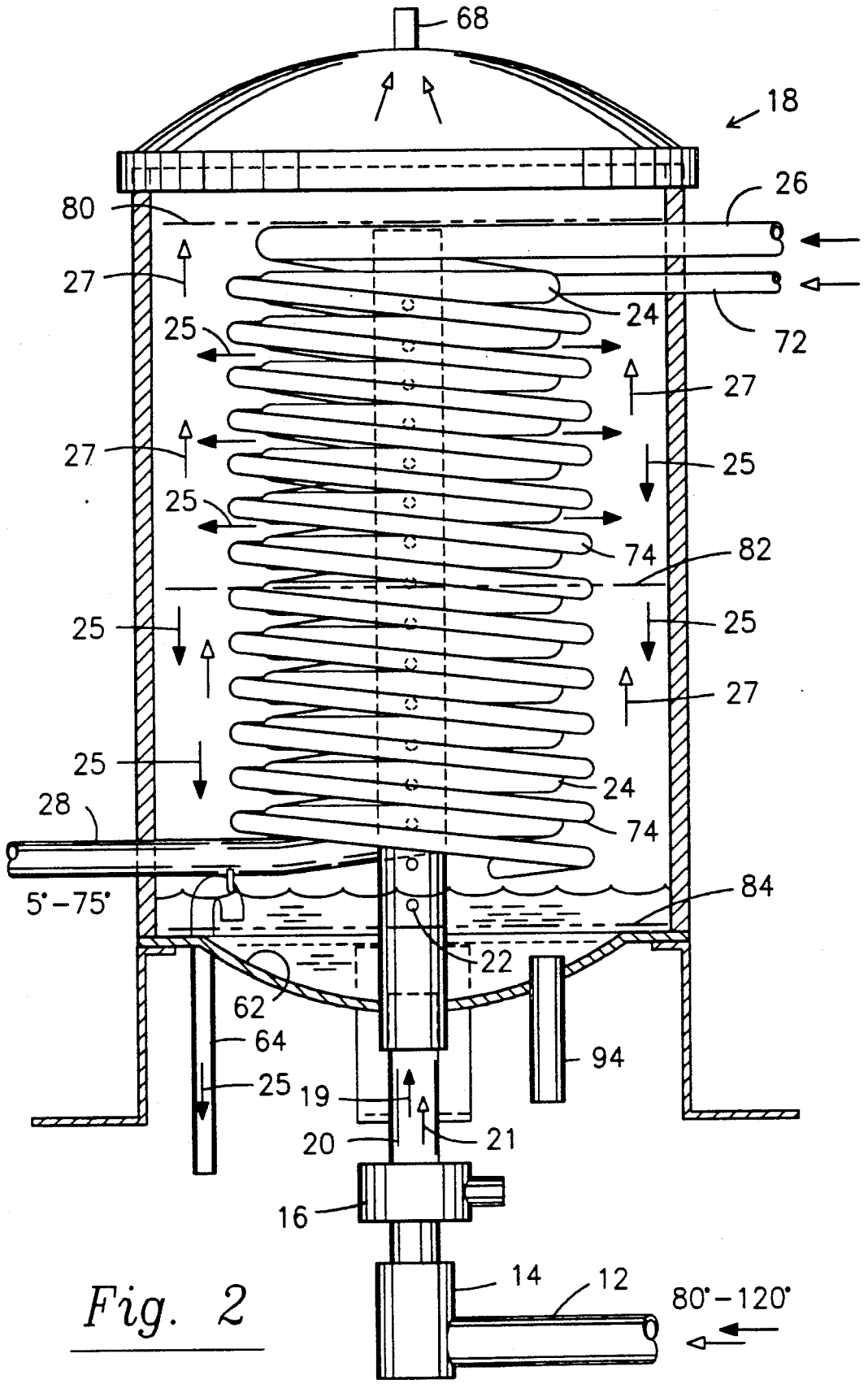
FIG. 2 is a side elevational, cut away view of the purge vessel shown diagrammatically in FIG. 1.

The interior of purge vessel 18 is shown in FIG. 2. Conduit 20 extends from solenoid 16 into the interior of purge vessel 18 as shown, and openings, collectively denoted 22, are formed therein along the extent thereof. More particularly, there are four parallel sets of said openings 22, although only one set is shown; the others are disposed at ninety degree intervals about the circumference of conduit 20. The pressure inside conduit 20 is greater than the pressure inside purge vessel 18; thus, the dry, hot gases in said conduit flow radially outwardly through said openings 22 and enter the cold interior of purge vessel 18.

The interior of purge vessel 18 is maintained cold by zero degree liquid refrigerant that flows through a coil 24 (hereinafter sometimes referred to as the inner coil, and in the claims referred to as the first evaporator coil), that is disposed around conduit 22; the inlet of said inner coil is denoted 26 in the upper right hand corner of FIG. 2; it is referred to as the second inlet of the purge vessel in the claims. FIG. 1 shows inlet 26 as well and further depicts the circuit of which it is a part. Outlet 28 is the opposite end or outlet of inner coil 24, as shown. In the claims, it is referred to as the second outlet of the purge vessel.

Vapor exiting vessel 18 flows through outlet 28 and conduit 30 having sensitive, electronic temperature sensors 32, 34, and 36 positioned therewithin (FIG. 1), and enters suction accumulator 40 which performs the function of preventing liquids from entering compressor 44 through inlet conduit 42. Hot, compressed refrigerant is discharged by compressor 44 into compressor outlet conduit 46; said refrigerant is condensed in condenser 48, which includes condenser motor 49, and condensed liquid refrigerant travels through conduit 50 to receiver 52 which is a reservoir for liquid refrigerant. Under low load conditions, receiver 52 holds excess liquid refrigerant. Under high load conditions, it holds less; it will hold no excess liquid refrigerant when the system is under full load conditions. The metering means that adds and withdraws liquid refrigerant to and from the system as needed is metering means 60, disclosed below. Next, the liquid refrigerant flows through conduit 54 to liquid line drier 56 which performs the function its name expresses. A sight glass 58, also positioned in conduit 54, enables visual inspection of the system; undesired water, for example, will be visually detectable upon observation of said sight glass. Conduit 54 then carries the liquid refrigerant to suction pressure regulating expansion valve/metering means 60 which meters minus 10 degree refrigerant into said vessel first inlet 26 and hence into inner coil 24. Metering means 60 also meters liquid refrigerant in receiver 52 into the auxiliary condensation system as load conditions demand, as mentioned above.

It should be clear that the circuit just described is a closed system and has no connection with the primary refrigeration circuit of which the chiller barrel is a part; the primary purpose of the circuit just described is to deliver zero degree refrigerant fluid to inner coil 24.

At least some of the hot gaseous fluids flowing out of conduit 20 through openings 22 are condensed upon contact with inner coil 24; such condensate is denoted 25 in FIG. 2. Note that condensate 25 falls to the bottom 62 of purge vessel 18 under the influence of gravity.

Condensate 25 that collects on bottom 62 accumulates until a pool of cold condensate overlies said bottom. The depth of said pool is limited by the presence of an artesian well means 64 having vent 65; when the condensate rises to a predetermined level, a siphoning action begins and condensate 25 is returned to the bottom of the chiller barrel by a conduit means that is also labeled 64 because it is an integral part of said artesian well means. In the claims, the artesian well means 64 is sometimes referred to as the first purge vessel outlet.

However, since incoming hot gaseous refrigerant 21 contains noncondensibles, not all of said refrigerant will become condensate 25 The gaseous vapor remaining within purge vessel 18 is cool and resistant to condensation; it is denoted 27 in FIG. 2. As such gases 27 accumulate, the temperature within purge vessel 18 and hence within outlet conduit 30 (FIG. 1) decreases, thereby indicating that purge vessel 18 is filling with noncondensibles. Such low temperature also inhibits further condensation of the gaseous fluids flowing out of openings 22. Electronic temperature sensor 36, shown in FIG. 1 as aforesaid, continuously monitors the temperature of the vapor exiting vessel 18 through outlet conduit 30; when a saturation temperature of twenty five degrees is reached, indicating the purge vessel 18 is about eighty percent (80%) filled with noncondensibles, it sends an electrical signal which closes solenoid-controlled valve 16 and which activates electronic sensors 32 and 34. Since the temperature within the purge vessel will be about seventy five degrees most of the time, this avoids needless continuous monitoring of said purge vessel temperature by said sensors 32, 34. As the noncondensibles continue to accumulate with vessel 18, the temperature therewithin will continue to drop. When the temperature drops to fifteen degrees, sensor 34 opens solenoid-controlled valve 66 (upper part of FIG. 1) and starts purge pump 69 so that gaseous fluid 27 may flow through restricter 67 which is positioned in the third purge vessel outlet, i.e., conduit 68, into reheat and re-expansion coil 70 (coil 70 and conduit 68 are the same conduit). Sensor 34 is referred to in the claims as the first sensor means. Hot gases from compressor 44 flow through conduit 46 and heat is therefore exchanged, i.e., the gases in coil 70 are heated and expanded. Since said gases are heated and expanded in the unillustrated primary air conditioning system, this particular heating and expansion is referred to as a reheating and re-expansion. The reheated and re-expanded gases reenter purge vessel 18 through conduit 72, referred to as the third purge vessel inlet in the claims, and which is in open fluid communication with coil 70 as shown; reentry conduit 72 is also shown in FIG. 2.

As shown in FIG. 2, conduit 72 has a coiled part, denoted 74, that coils about central conduit 20 in the same way as inner coil 24. Coils 74 and 24 abut one another along their mutual extent with coil 74 being the outer coil so that the minus 10 degree liquid refrigerant flowing in inner coil 24 cools the reheated and re-expanded gaseous refrigerant in outer coil 74. The reheated and re-expanded gaseous refrigerant will have a maximum temperature of about ninety degrees Fahrenheit when it enters purge vessel 18; condensation will begin almost immediately when said refrigerant comes into heat-exchanging relation to inner coil 24, but will not be complete until said gases have traveled the entire extent of outer coil 74, i.e., until said gases have reached the lowermost extent of outer coil 74.

More particularly, the initial saturation point, near the top of vessel 18, is denoted 80 in the upper left hand corner of FIG. 2; the middle saturation point is denoted 82, and the final saturation point is denoted 84. The dwell time of the reheated and re-expanded gases in outer coil 74 is about three minutes; this allows adequate time for all condensibles in said gases to condense and separate from the true noncondensibles. Thus, condensed condensibles and true noncondensibles will exit the lowermost end of coil 74 which is positioned slightly above (about one-quarter inch) the highest possible surface of the liquid refrigerant/condensate. The condensate joins said pool of condensate lying atop bottom wall 62 as mentioned earlier, and eventually returns to the chiller barrel through the above-mentioned artesian well means.

The true noncondensibles collect within purge vessel 18 above said condensate and again cause the temperature therewithin to drop. When the temperature of the gases leaving vessel 18 (through second outlet means 28) reaches a predetermined temperature such as five degrees Fahrenheit, indicating that said vessel is almost completely filled with noncondensibles, electronic temperature sensor 32 in conduit 30 (FIG. 1) senses said temperature, closes solenoid-controlled valve 66 to prevent gas flow into reheat and re-expansion coil 70, and opens solenoid-controlled valve 90. This allows the true noncondensibles, which are environmentally harmless, to enter the atmosphere through vent pipe 92; this structure is referred to as the fourth purge vessel outlet in the claims. Sensor 32 is there referred to as the second sensor means, and sensor 36, which activates sensors 32 and 34, is referred to as the third sensor means.

Service drain 94 at the bottom of purge vessel enables draining of said vessel for maintenance purposes.

This invention is clearly new and useful. Moreover, it was not obvious to those of ordinary skill in this art at the time it was made, in view of the prior art considered as a whole as required by law.

It will thus be seen that the objects set forth above, and those made apparent from the foregoing description, are efficiently attained and since certain changes may be made in the above construction without departing from the scope of the invention, it is intended that all matters contained in the foregoing construction or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described,

What is claimed is:

1. A thermal purge system, comprising:

a secondary refrigeration system auxiliary to a primary refrigeration system;

a reheat and re-expansion means that forms a part of said secondary refrigeration system;

a purge vessel having three inlets and four outlets;

a first inlet comprising means receiving hot gaseous refrigerant fluid from a chiller means that forms a part of said primary refrigeration system;

a second inlet comprising means receiving low temperature refrigerant fluid from said secondary refrigeration system;

a third inlet comprising means for receiving reheated and re-expanded refrigerant fluid from said reheat and re-expansion means;

a first outlet comprising means for discharging condensed refrigerant fluid from said vessel and returning it to said chiller means;

a second outlet comprising means for discharging vapor from said vessel and returning it to said secondary refrigeration system;

a third outlet comprising means for routing condensibles and noncondensibles to said reheat and re-expansion means;

a fourth outlet comprising means for routing noncondensibles from said purge vessel into the atmosphere;

a first evaporator coil disposed within said vessel comprising means for condensing, at least in part, said hot gaseous refrigerant fluid received from said chiller means;

said first evaporator coil having an inlet in fluid communication with said purge vessel second inlet, and said first evaporator coil having an outlet in fluid communication with said purge vessel second outlet;

said secondary refrigeration system maintaining the temperature of the refrigerant fluid in said first evaporator coil at a predetermined low temperature;

a second evaporator coil disposed within said vessel in heat transfer relation to said first evaporator coil;

said second evaporator coil being in fluid communication with said third inlet so that said second evaporator coil receives said reheated and re-expanded refrigerant fluid from said reheating and re-expanding means, said condensibles in said reheated and re-expanded refrigerant fluid being condensed as a result of a temperature differential between said first and second evaporator coils and said noncondensibles being separated from said condensibles; and means for purging said noncondensibles from said vessel through said fourth outlet after said noncondensibles have been reheated, re-expanded, and subjected to the low temperature of said refrigerant fluid in said first evaporator coil.

2. The system of claim 1, further comprising a first temperature sensor disposed in communicating relation to said second outlet of said vessel to monitor the temperature of vapor in said outlet of said first evaporator coil, said first temperature sensor adapted to close said purge vessel first inlet when the temperature of said vapor reaches a predetermined temperature and to open said purge vessel third outlet so that said condensibles and noncondensibles in said vessel are routed to said reheat and re-expansion means.

3. The system of claim 2, further comprising a second temperature sensor disposed in communicating relation to said second outlet of said vessel to monitor the temperature of vapor in said outlet of said first evaporator coil, said second temperature sensor adapted to open a vent to atmosphere to release noncondensibles from said vessel through said purge vessel fourth outlet when the temperature of said vapor in said first evaporator coil outlet reaches a predetermined temperature after said second sensor has closed said first inlet and opened said third outlet, said second sensor also being adapted to close said third outlet when said vent is opened, said third outlet being downstream of said vent, and said second sensor further being adapted to close said vent and to open said first inlet a predetermined time after opening said vent.

4. The system of claim 3, wherein said secondary refrigeration system comprises a compressor having a suction side and a discharge side, and further comprises a condensor, a receiver, a liquid sight glass, a liquid line drier, and a suction regulating expansion valve disposed between said compressor discharge side and said second inlet.

5. The system of claim 4, wherein said secondary refrigeration system further includes a suction accumulator disposed between said second outlet and said suction side of said compressor.

6. The system of claim 5, further comprising a drier means disposed between said chiller means and said first inlet.

7. The system of claim 6, further comprising a restricter means disposed in fluid communication with said third outlet.

8. The system of claim 7, further comprising a purge pump disposed in fluid communication with said third outlet.

9. The system of claim 8, further comprising a third temperature sensor disposed in fluid communication with said second outlet, said third sensor adapted to activate said first and second sensors when the temperature within said vessel drops to a predetermined level.

10. A thermal purge system, comprising:

a purge vessel having a top and a bottom;

said purge vessel further having a first, a second, and a third inlet and a first, a second, a third, and a fourth outlet;

said first inlet being in fluid communication with an outlet conduit of a chiller means, said outlet conduit carrying hot gaseous refrigerant fluid;

a central conduit disposed in said purge vessel, substantially centrally thereof, said central conduit being in fluid communication with said outlet conduit of said chiller means;

a plurality of openings formed in said central conduit so that said hot gaseous refrigerant fluid escapes into an interior of said purge vessel through said plurality of openings;

a condensation means disposed in said vessel interior for cooling said hot gaseous refrigerant fluid and causing said hot gaseous refrigerant fluid to at least partially condense and collect on said bottom of said purge vessel;

an artesian well means disposed in fluid communication with said vessel first outlet so that liquid refrigerant that collects on the bottom of said purge vessel is routed by said artesian well means to a bottom of said chiller means when said liquid refrigerant attains a predetermined depth on said vessel bottom;

a refrigeration means for delivering cold refrigerant to said purge vessel second inlet;

said condensation means including a first evaporator coil disposed in said purge vessel, said first evaporator coil being disposed in fluid communication between said purge vessel second inlet and said purge vessel second outlet so that said cold refrigerant flows through said first evaporator coil before exiting said vessel at said second outlet;

said condensation means causing condensation of said hot gaseous refrigerant fluid by impingement of said hot gaseous refrigerant fluid on said first evaporator coil;

said hot gaseous refrigerant fluid containing at least some condensibles that are not condensed when said hot gaseous refrigerant fluid contacts said first evaporator coil and containing at least some noncondensibles;

said purge vessel further comprising means to cause said noncondensed condensibles and said noncondensibles to collect within said purge vessel interior in a space between said top of said purge vessel and a surface of liquid refrigerant collected atop said bottom of said purge vessel;

said refrigerant means for delivering cold refrigerant to said purge vessel second inlet including a compressor that delivers hot, compressed compressor discharge gas to a compressor outlet conduit that forms a part of said refrigerant circuit;

a reheating and re-expansion coil disposed in heat exchanging relation to said compressor outlet conduit;

said reheating and re-expansion coil having an inlet disposed in fluid communication with said purge vessel third outlet and having an outlet disposed in fluid communication with said purge vessel third inlet so that reheated and re-expanded noncondensed condensibles and noncondensibles are reintroduced into the interior of said purge vessel;

a second evaporator coil disposed in said purge vessel interior, said second evaporator coil being in heat-transfering relation to said first evaporator coil;

said second evaporator coil having an inlet in fluid communication with said purge vessel third inlet disposed in fluid communication downstream of said reheating and rexpansion coil so that reheated and re-expanded gases enter said second evaporator coil;

said second evaporator coil having an outlet in fluid communication with the interior of said purge vessel slightly above said surface of said liquid refrigerant collected atop said vessel bottom so that condensed condensibles enter said purge vessel interior and accumulate on said bottom thereof until returned to said chiller means by said artesian well means and so that noncondensibles collect in said purge vessel interior above said surface of said liquid refrigerant; and purge means for purging said noncondensibles from said purge vessel interior.

11. The system of claim 10, further comprising a first temperature sensor disposed in communicating relation to said second outlet of said vessel to monitor the temperature of vapor exiting said vessel in said first evaporator coil, said first temperature sensor adapted to close said purge vessel first inlet when the temperature of said vapor reaches a predetermined temperature and to open said purge vessel third outlet so that said condensibles and noncondensibles in said purge vessel are routed to said reheat and re-expansion means.

12. The system of claim 11, further comprising a second temperature sensor disposed in communicating relation to said second outlet of said purge vessel to monitor the temperature of vapor exiting said purge vessel in said first evaporator coil, said second temperature sensor adapted to open a vent to atmosphere to release noncondensibles from said purge vessel when the temperature of said vapor exiting said vessel reaches a predetermined temperature after said second sensor has closed said first inlet and opened said third outlet, said second sensor also being adapted to close said third outlet when said vent is opened, said third outlet being downstream of said vent, and said second sensor further being adapted to close said vent and to open said first inlet a predetermined time after opening said vent.

13. The system of claim 12, wherein said refrigeration means comprises a compressor having a suction side and a discharge side, and further comprises a condensor, a receiver, a liquid sight glass, a liquid line drier, and a suction regulating expansion valve disposed between said compressor discharge side and said second inlet.

14. The system of claim 13, wherein said refrigeration means further includes a suction accumulator disposed between said second outlet and said suction side of said compressor.

15. The system of claim 14, further comprising a drier means disposed between said chiller means and said first inlet.

16. The system of claim 15, further comprising a restricter means disposed in fluid communication with said third outlet.

17. The system of claim 16, further comprising a purge pump disposed in fluid communication with said third outlet.

18. The system of claim 17, further comprising a third temperature sensor disposed in fluid communication with said second outlet, said third sensor adapted to activate said first and second sensors when the temperature within said purge vessel interior drops to a predetermined level.

* * * * *